US006491374B1

(12) United States Patent
Bauer et al.

(10) Patent No.: US 6,491,374 B1
(45) Date of Patent: Dec. 10, 2002

(54) METHODS AND APPARATUSES FOR PRINTING WITH UNIFORM AND NON-UNIFORM PRINT MASK FUNCTIONS

(75) Inventors: Stephen W. Bauer, San Diego, CA (US); Grant A. Webster, Valley Center, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/060,619

(22) Filed: Jan. 30, 2002

(51) Int. Cl.[7] ..... B41J 2/21
(52) U.S. Cl. ..... 347/43; 347/15; 347/41
(58) Field of Search ..... 347/43, 15, 41, 347/16, 12

(56) References Cited

U.S. PATENT DOCUMENTS 5,384,587 A * 1/1995 Takagi et al. ..... 347/41
6,254,217 B1 * 7/2001 Askeland et al. ..... 345/15
6,273,549 B1 * 8/2001 Wetchler et al. ..... 347/12

* cited by examiner

*Primary Examiner*—Lamson Nguyen

(57) ABSTRACT

Improved methods and apparatuses are provided for use in printing color swaths in a bi-directional printing device. The bi-directional printing device is configured to use a plurality of color inks including at least one light color ink and at least one dark color ink. One method includes selectively printing at least one dark color ink on a print media based on a non-uniform probabilistic print mask function, and selectively printing at least one light color ink on the print media based on a substantially uniform probabilistic print mask function.

23 Claims, 3 Drawing Sheets

METHODS AND APPARATUSES FOR PRINTING WITH UNIFORM AND NON-UNIFORM PRINT MASK FUNCTIONS

BACKGROUND

Color printing devices, such as, for example, ink-jet printers operate by applying small drops of ink to a print media (e.g., paper), thereby forming dots. Different colored dots are combined to form a variety of desired colors. By way of example, certain ink-jet printers utilize four different colors of ink, namely, cyan, magenta, yellow, and black. These inks are typically supplied by ink printheads having several nozzles, which can be selectively controlled to eject drops of ink onto the print media. The printheads are typically arranged in a printhead carriage that is moveably controlled by a transport mechanism such that a swath of color can be applied to a portion of the print media by selectively controlling the ink printheads moving in relation to the print media.

Certain printing devices are configured to print bi-directionally. This means, for example, that swaths may be printed as the carriage moves across the print media from a right hand side to a left hand side and then back across the paper from the left hand side to the right hand side. This bi-directional movement is then continued on down the print media, as needed to print the desired content.

To reduce the visibility of certain print errors in the resulting print, some printing devices apply selected probabilistic or other like functions in the printing logic to control the usage of nozzles within the printheads. Such probabilistic functions typically print less ink from nozzles near the ends of the printhead. In printing devices such as these, it has been found, however, that for certain colors the bi-directional printing of swaths can lead to the formation of other print errors such as undulating color variations. These variations form unwanted hue shifts that may cause visually noticeable bands in the resulting print.

Consequently, there is a need for improved methods and apparatuses for significantly reducing or eliminating visible hue shift banding in bi-directional color printing devices.

SUMMARY

In accordance with certain aspects of the present invention, improved methods and apparatuses are provided for significantly reducing or eliminating visible hue shift banding and/or other like defects produced in bi-directional color printing.

The above stated needs and others are met, for example, by a method for use in printing color swaths in a bi-directional printing device. The bi-directional printing device is configured to use a plurality of color inks including at least one light color ink and at least one dark color ink. The method includes selectively printing at least one dark color ink on a print media based on a non-uniform print mask function. The method further includes selectively printing at least one light color ink on the print media based on a substantially uniform print mask function.

In accordance with still other implementations of the present invention, a printing device that is capable of printing color swaths bi-directionally is provided. Here, the printing device includes a printing mechanism that is controlled by logic. The printing mechanism is configurable to selectively print color swaths on a print media using a plurality of color inks including at least one light color ink and at least one dark color ink. The logic is operatively configured to cause the printing mechanism to selectively print the dark color ink on the print media in a non-uniform probabilistic manner, and selectively print the light color ink on the print media in a substantially uniform probabilistic manner.

BRIEF DESCRIPTION OF THE DRAWINGS

A more complete understanding of the various methods and apparatuses of the present invention may be had by reference to the following detailed description when taken in conjunction with the accompanying drawings wherein.

DETAILED DESCRIPTION

Figure 1:
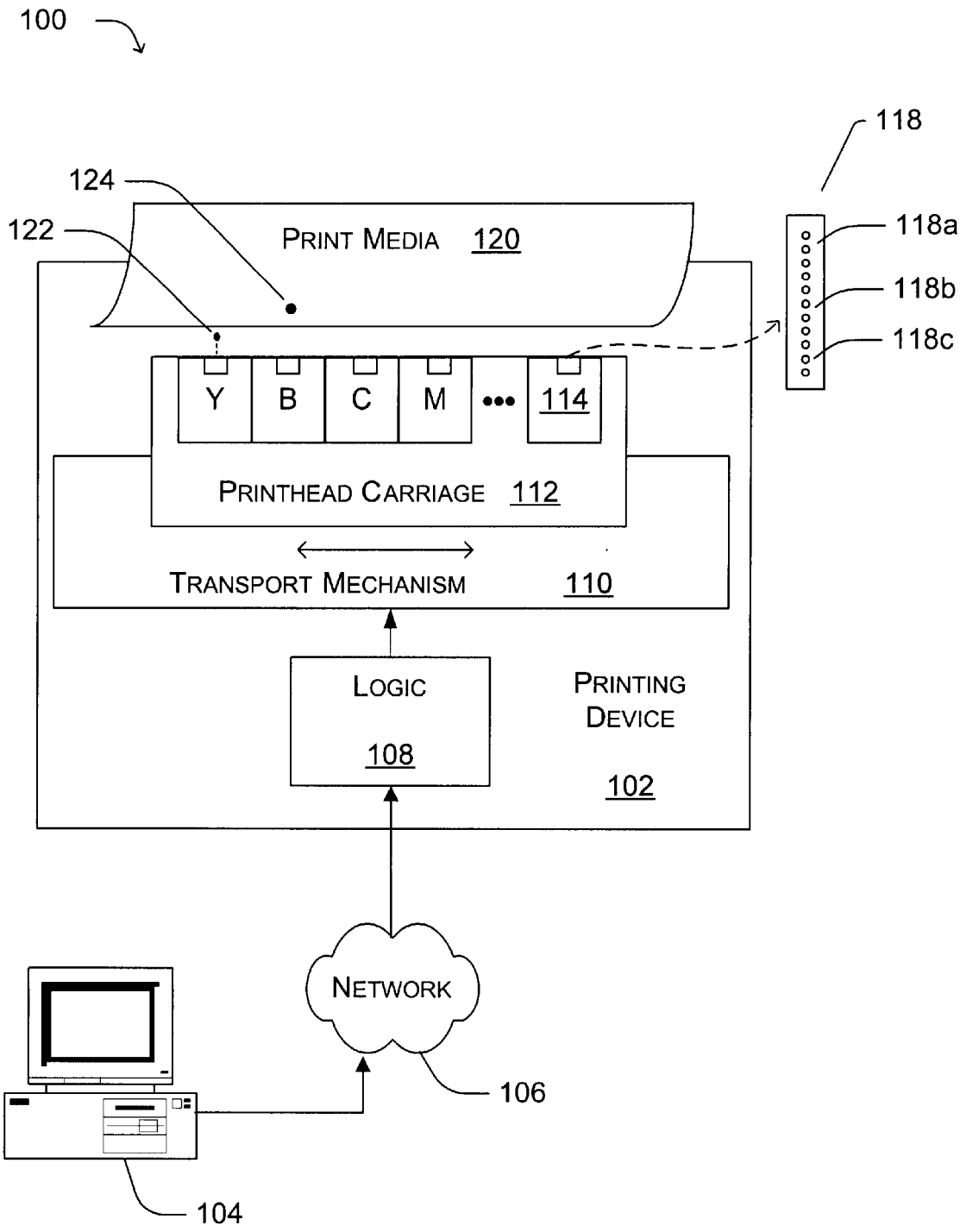
FIG. 1 is a block diagram depicting a printing environment having a color printing device that is advantageously configured to reduce or eliminate hue shifts or other like variations that tend to cause unwanted banding in the final printed image, in accordance with certain exemplary implementations of the present invention.

FIG. 1 depicts an exemplary printing environment 100 that includes a printing device 102. Printing device 102 is representative of any device that is configured to selectively apply at least two different colors of a marking substance (e.g., ink, dye, toner, etc.) to a print medium 120. Thus, for example printing device 102 may include a printer, a copier, a facsimile machine, a combination of these devices, or other like device.

As described in the exemplary implementations below, printer 102 takes the form of an ink-jet printer, which is operatively coupled to a computer 104 through a network 106. Computer 104 is representative of any device capable of providing print and/or control data to printing device 102. Network 106 is representative of any communication resource and/or link capable of carrying print and/or control data from computer 104 to printing device 102. Thus, by way of example, network 106 can represent a wired connection and/or a wireless connection.

Printing device 102 includes logic 108 that is configured to control the printing process. Logic 108 may include hardware, firmware, and/or software. Logic 108, in this example, is configured to receive print data from computer 104 via network 106. Logic 108 then orchestrates the corresponding printing process. Here, for example, logic 108 directs a transport mechanism 110, which is configured to selectively move a printhead carriage 112 with respect to print medium 120. Print medium 120 is also configured to be selectively moved with respect to printhead carriage 112, for example, by a print media transport mechanism (not shown).

Printhead carriage 112 includes at least one printhead 114. In this implementation, for example, a plurality of printheads is included in printhead carriage 112. Here, each printhead 114 provides a color ink, e.g., yellow (Y), black (B), cyan (C), and magenta (M). This is a representative set of inks. In other implementations, there may be any number of inks and/or different ink colors. In still other implementations, a single printhead may be configured to provide a plurality of different inks.

Since this exemplary implementation is an ink-jet printer, printhead 114 provides a plurality of nozzles 118. Nozzles 118 may be logically and/or physically grouped as an array or other like arrangement. Each nozzle is configured to selectively eject an ink drop 122, which causes a dot 124 on print medium 120. During printing, for example, transport mechanism 110 moves print carriage 112 and ink drops 122 are selectively placed on print medium 120 to form a color swath comprised of a plurality of dots.

In this example, printing device 102 is a bi-directional printer, which means that printhead carriage 112 prints in two directions of movement. Here, for example, printhead carriage 112 moves left to right (L2R) and right to left (R2L) with respect print medium 120, which moves up and/or down with respect to printhead carriage 112.

As these and other print engines, printheads and printing processes/mechanisms and techniques are well known, the remaining description will focus on certain problems that have been detected in a bi-directional printing process and provide a description of improved methods and apparatuses to address such problems.

It has been found that the order in which the various inks are applied to print medium 120 affects certain final resulting colors. This is particularly noticeable in areas that have neutral colors (e.g., grays and other colors wherein human visual perception is particularly sensitive to subtle color changes). For example, if C ink is applied before M ink, then the resulting color may be different than if M ink is applied before C ink. As described below, one particular problem is caused by the order in which Y ink is applied during bi-directional printing.

Figure 2:
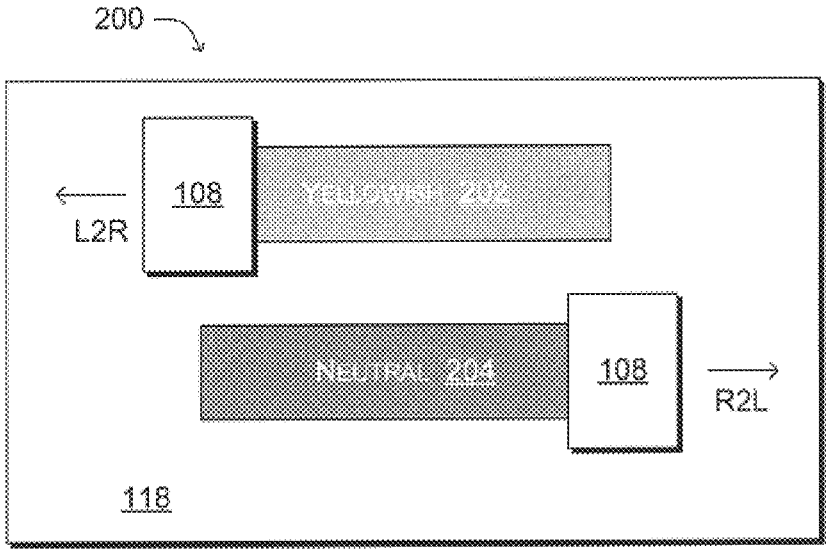
FIG. 2 is a diagram illustratively depicting visible differences in two neutral color swaths that were printed in opposite directions.

Since the pens 114 are in a fixed order in printhead carriage 112, the order of the pens depends upon the print direction of movement of printhead carriage 112. Consequently, the resulting swaths from printing R2L and L2R will for certain colors have a different hue that is visually noticeable. One particular example of a hue difference between R2L and L2R swaths is due to the order in which the Y ink is applied. This is illustratively depicted in FIG. 2, which shows a printing process 200 wherein printhead carriage 112 makes a first swath 202 of a neutral color while moving R2L, and subsequently makes a second swath 204 of the same neutral color while moving L2R. In this example, per FIG. 1, printhead carriage 112 has four identified color pens 114 that are in the following order (from left to right), Y ink, B ink, C ink, and M ink. Thus, when printhead carriage 112 is moved R2L the Y ink is applied before any B, C or M ink is applied. Conversely, when printhead carriage 112 is moved L2R the Y ink is applied after any M, C or B ink is applied.

As a result of this type of ink application order and other similar orders, when printing neutral colors it has been found that first swath 202 tends to appear more yellowish than second swath 204. One possible reason for this is that an ink drop placed on a blank or dry print media 122 tends to spread further (i.e., have a higher dot gain) than the same sized drop placed on a previously wetted print media 122 following the placement of one or more inks thereon. Thus, in the R2L direction at least some of the Y ink drops will be applied to dry media, and in the L2R direction at least some of the Y ink drops will be applied to wet media.

As mentioned, such hue variations in the resulting image are often visible; this is especially true for larger areas of the same color that span a number of adjacent swaths, wherein the L2R swaths have a different color than the R2L swaths.

Some of this banding can be reduced through multi-pass printing, wherein such variations in color would typically get covered up, since a given area would typically have an equal amount of L2R and R2L printing. Unfortunately, even in multi-pass printing it has been found that hue shift banding can occur and can occur when using ramp print masks.

To better understand how such hue shift banding may occur, one needs to examine the technique of using ramp print masks. Ramp print masks are useful in reducing other types of banding caused, for example, by location errors such as, e.g., step advance errors, dot placement errors, and the like. Basically, ramp print mask techniques include using the upper end nozzles 118*a* less than middle nozzles 118*b* and using lower end nozzles 118*c* less than middle nozzles 118*b*, such that the probability of usage of middle nozzles 118*b* is higher than the probability of usage of upper end nozzles 118*a* and lower end nozzles 118*c*. To compensate for the reduced printing preformed by the end nozzles 118*a* and 118*c* and thus the reduced amount of ink printed on the corresponding areas of print medium 120 during a single printing pass, these areas are typically printed over by at least one subsequent swath.

Figure 3:
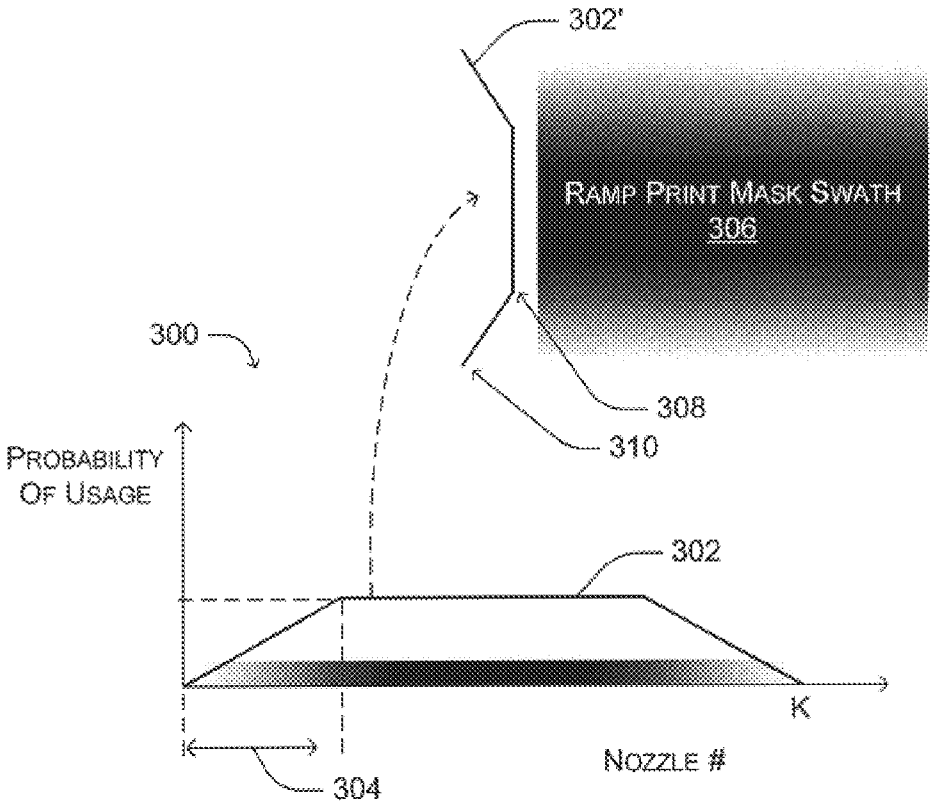
FIG. 3 includes a line graph that illustrates an exemplary ramp print mask function and a corresponding illustrative swath.

FIG. 3 illustrates an exemplary ramp print mask technique. As shown in line graph 300, a ramp print mask function 302 can be operatively applied to nozzles 118 in a pen 114. The y-axis represents the probability of usage that is applied to each (numbered) nozzle 118. The x-axis represents the nozzles 118 by number. Here, the nozzles are numbered from 0 to K. In certain implementations, for example, the probability of usage is ramped up from a low percentage to a higher percentage (e.g., about 0% to about 100%) near the end nozzles 118*a* and later ramped down from a high percentage to a lower percentage (e.g., about 100% to about 0%) for end nozzles 118*c*. The number of nozzles that are in the up ramp and down ramp may, for example, be established based on the height of the swath being printed. Note, in certain implementations only nozzles 118 near one of the ends of the pen may be ramped.

Also depicted in FIG. 3 is an illustrative representation of a ramp print mask swath 306 that was printed applying ramp print mask function 302, which effectively causes very little if any ink (probability of usage about 0%) to be applied by the nozzle(s) near point 310 and much more ink to be applied by the nozzle(s) near point 308 (probability of usage about 100%).

One problem with this exemplary ramping technique is that some areas of each swath have effectively been printed more L2R than R2L, while other areas of other swaths have effectively been printed more R2L than L2R. Because of the variation in the usage of nozzles 118, as defined by ramp print mask function 302, the resulting color may have visually noticeable undulations of color going down the print media. Thus, rather than some of the swaths being too yellow, for example, there will be variation within the swaths of gray color.

When examined closely each swath printed using a ramp print masks would have undulations across it that would appear to be more yellowish near the top. Thus, there can be a color or hue shift within a swath from the top to the bottom of the swath.

Solutions that reduce or eliminate such undulating color within the swaths are provided herein in the form of improved methods and apparatuses. These methods and apparatuses advantageously allow for ramp print masks and other like techniques to be used in promoting improved dot placement and/or controlling banding and/or controlling banding errors, without undesirable hue shift effects occurring as a side effect.

While hue shift effects associated with the order of ink deposition are often noticeable, human vision tends to be less sensitive to location errors in yellow dot placement than the dark ink colors (e.g., C, M, K). As such, it has been found that the Y ink can be deposited without use of a ramp print mask, while the other colors may still have ramp print masks applied to them.

Thus, in accordance with certain aspects of the present invention, light color ink such as Y ink is printed without applying a ramped print mask, while C ink, M ink, K ink, and/or other dark inks may be printed using ramped print masks. The result is a reduction or elimination of the color undulations resulting from differences in light ink drop deposition caused by ramped print masks and/or variations dependent upon whether (light) ink is printed first (earlier) or last (latter) in a swath.

Figure 4:
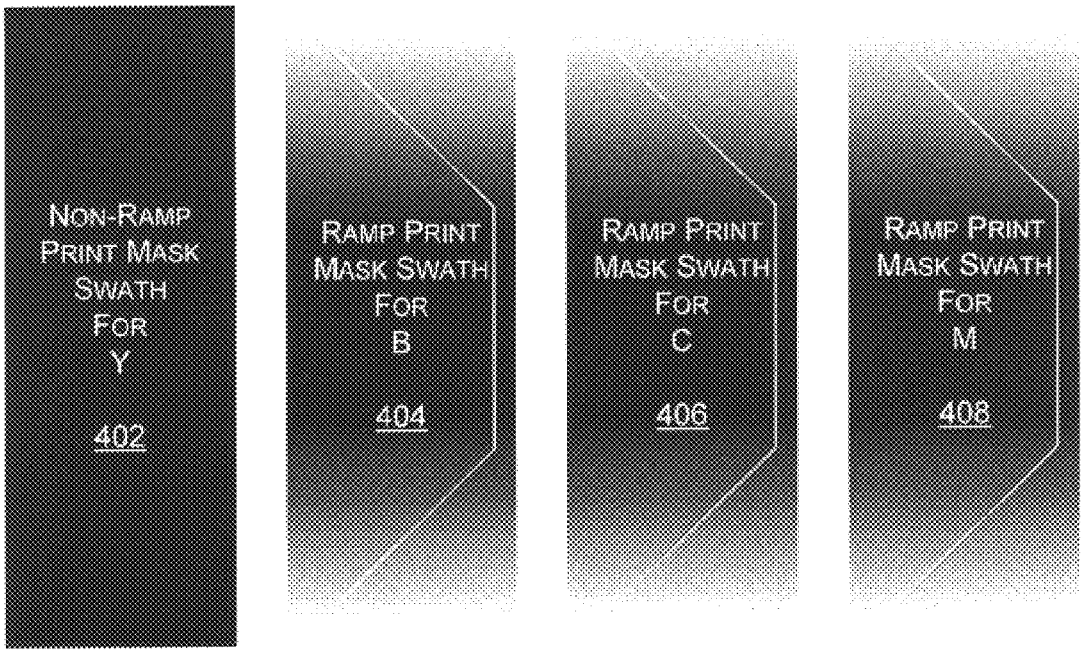
FIG. 4 includes a line graph that illustrates a non-ramp print mask function that is applied to yellow (Y) ink, a corresponding illustrative swath of Y ink, and illustrative ramp print mask function based swaths of black (B) ink, cyan (C) and magenta (M), in accordance with certain exemplary implementations of the present invention.
Figure 4:
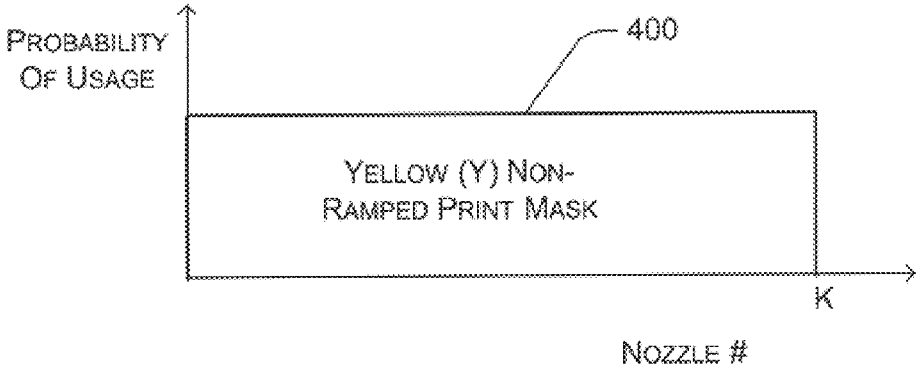

Such techniques are illustratively depicted in FIG. 4, wherein a non-ramped print mask 400 is applied (or similarly, a non probabilistic print mask is applied) for the Y ink. Exemplary representative swaths are depicted above the line graph. Here, a non-ramp print mask swath for Y ink 402 illustrates that all of the nozzles have about the same probability of usage as indicated by the substantially uniform shade (all dark) of the swath. Representative probabilistic ramp print mask swaths are also depicted for B ink (404), C ink (406) and M ink (408). As with swath 306 in FIG. 3, swaths 404, 406 and 408 illustrate that some of the nozzles have different probabilities of usage as indicated by the non-uniform (gradient) shades within each swath. Note, that the ramp print mask functions may be different for each color of ink.

In accordance with certain implementations of the present invention, therefore, logic 108 may be operatively configured to apply a non-ramped, substantially uniform print mask function 400 to the Y ink pen controlling signals. In other implementations the same result may be achieved by not even applying a probabilistic print mask function to the Y ink pen controlling signals. The remaining ink pens may then have a probabilistic or other like ramp print function applied to their controlling signals to help reduce the potential for noticeable bands and/or other print errors. Since the light color Y ink tends to be less noticeable in the resulting image, any other potential errors that are created by not applying a non-uniform ramp print mask to the Y ink do not undesirably degrade the resulting print.

Although some preferred embodiments of the various methods and apparatuses of the present invention have been illustrated in the accompanying Drawings and described in the foregoing Detailed Description, it will be understood that the invention is not limited to the exemplary implementations disclosed, but is capable of numerous rearrangements, modifications and substitutions without departing from the spirit of the invention as set forth and defined by the following claims.

What is claimed is:

1. A method for use in printing color swaths in a bi-directional printing device being configured to use a plurality of color inks including at least one light color ink and at least one dark color ink, the method comprising:

selectively printing said at least one dark color ink on a print media based on a non-uniform print mask function; and selectively printing said at least one light color ink on said print media based on a substantially uniform print mask function.

2. The method as recited in claim 1, wherein said at least one light color ink includes yellow ink.

3. The method as recited in claim 1, wherein said at least one dark color ink includes ink selected from a group of inks comprising black ink, cyan ink and magenta ink.

4. The method as recited in claim 1, wherein said non-uniform mask function includes a probabilistic ramp print mask function.

5. The method as recited in claim 1, wherein:

selectively printing said at least one dark color ink on said print media further includes selectively forming dots of said at least one dark color ink on said print media, and selectively printing said at least one light color ink on said print media further includes selectively forming dots of said at least one light color ink on said print media.

6. The method as recited in claim 5, wherein said printing device includes an ink-jet printer.

7. A method for use in a printing device, the method comprising:

printing color swaths in a bi-directional mode using a plurality of color inks including at least one light color ink and at least one dark color ink;

selectively printing said at least one dark color ink on a print media in a non-uniform probabilistic manner; and selectively printing said at least one light color ink on said print media in a substantially uniform probabilistic manner.

8. The method as recited in claim 7, wherein said at least one light color ink includes yellow ink.

9. The method as recited in claim 7, wherein said at least one dark color ink includes ink selected from a group of inks comprising black ink, cyan ink and magenta ink.

10. The method as recited in claim 7, wherein selectively printing said at least one dark color ink on said print media in said non-uniform probabilistic manner includes selectively varying the probabilistic usage of nozzles in a dark color ink pen in accordance with a ramp print mask function.

11. The method as recited in claim 7, wherein selectively printing said at least one light color ink on said print media in said substantially uniform probabilistic manner includes not substantially varying the probabilistic usage of nozzles in a light color ink pen.

12. The method as recited in claim 7, wherein:

selectively printing said at least one dark color ink on said print media in said non-uniform probabilistic manner further includes selectively forming dots of said at least one dark color ink on said print media, and selectively printing said at least one light color ink on said print media in said substantially uniform probabilistic manner further includes selectively forming dots of said at least one light color ink on said print media.

13. The method as recited in claim 12, wherein said printing device includes an ink-jet printer.

14. A printing device capable of printing color swaths bi-directionally, the printing device comprising:

a printing mechanism configurable to selectively print color swaths on a print media using a plurality of color inks including at least one light color ink and at least one dark color ink; and logic operatively coupled to said printing mechanism and configured to cause said printing mechanism to selectively print said at least one dark color ink on said print media in a non-uniform probabilistic manner, and selectively print said at least one light color ink on said print media in a substantially uniform probabilistic manner.

15. The printing device as recited in claim 14, wherein said at least one light color ink includes yellow ink.

16. The printing device as recited in claim 14, wherein said at least one dark color ink includes ink selected from a group of inks comprising black ink, cyan ink and magenta ink.

17. The printing device as recited in claim 14, wherein:

said printing mechanism includes a dark color ink pen having a plurality of ink ejecting nozzles; and said logic is configured to selectively vary the probabilistic usage of at least a portion of said plurality of nozzles in accordance with a ramped print mask function.

18. The printing device as recited in claim 14, wherein:

said printing mechanism includes a light color ink pen having a plurality of ink ejecting nozzles; and said logic is configured to not substantially vary the probabilistic usage of said nozzles in accordance with a non-ramped print mask function.

19. A method for printing image swaths with a bi-directional printer having a printhead for each color, each printhead having a logically linear arrangement of nozzles, the method comprising:

enabling deposition of a substantially equal number of drops from all nozzles of at least one light color ink printhead during printing of a swath; and enabling deposition of relatively fewer drops for end nozzles and relatively more drops from middle nozzles of at least one dark color ink print head during said printing of said swath.

20. The method as recited in claim 19, wherein the at least one light color ink printhead includes a yellow ink printhead, and the at least one dark color printhead is selected from a group of printheads comprising a cyan ink printhead, a magenta ink printhead, and a black ink printhead.

21. The method as recited in claim 19, wherein the at least one light color ink printhead is selected from a group of printheads comprising a yellow ink printhead, a light cyan ink printhead, and a light magenta printhead, and the at least one dark color printhead is selected from a group of printheads comprising a dark cyan ink printhead, a dark magenta ink printhead, and a black ink printhead.

22. An apparatus for use in printing color swaths in a bi-directional printing device being configured to use a plurality of color inks including at least one light color ink and at least one dark color ink, the apparatus comprising:

means for selectively printing said at least one dark color ink on a print media based on a non-uniform print mask function; and means for selectively printing said at least one light color ink on said print media based on a substantially uniform print mask function.

23. An apparatus for printing image swaths with a bi-directional printer having a printhead for each color, each printhead having a logically linear arrangement of nozzles, the apparatus comprising:

means for enabling deposition of a substantially equal number of drops from all nozzles of at least one light color ink printhead during printing of a swath; and means for enabling deposition of relatively fewer drops for end nozzles and relatively more drops from middle nozzles of at least one dark color ink print head during said printing of said swath.

* * * * *